US007523759B2

(12) United States Patent
van Loosbroek

(10) Patent No.: US 7,523,759 B2
(45) Date of Patent: Apr. 28, 2009

(54) PARASOL

(76) Inventor: Patrick Franciscus Johannes van Loosbroek, Halderheiweg 7, Boxtel (NL) 5282 SN ( * ) Notice: Subject to any disclaimer, the term of this patent is extended or adjusted under 35 U.S.C. 154(b) by 407 days.

(21) Appl. No.: 11/188,652

(22) Filed: Jul. 26, 2005

(65) Prior Publication Data

US 2006/0016465 A1 Jan. 26, 2006

(30) Foreign Application Priority Data

Jul. 26, 2004 (NL) ..... 1026727

(51) Int. Cl.
*A45B 19/00* (2006.01)
*A45B 25/24* (2006.01)

(52) U.S. Cl. ..... 135/21; 135/25.41; 135/34.2; 135/910

(58) Field of Classification Search ..... 135/90, 135/98, 16, 20.3, 21, 25.4, 34.2, 88.07, 910, 135/25.41; 362/102
See application file for complete search history.

(56) References Cited

U.S. PATENT DOCUMENTS

| | | | | | |
|---|---|---|---|---|---|
| 1,885,968 | A | * | 11/1932 | Wedemann | 135/25.41 |
| 2,183,833 | A | * | 12/1939 | Farhar | 135/20.3 |
| 3,534,752 | A | | 10/1970 | Vanzini | |
| 3,709,238 | A | * | 1/1973 | Leopoldi et al. | 135/15.1 |
| 3,935,874 | A | * | 2/1976 | Cohen | 135/16 |
| 4,543,971 | A | * | 10/1985 | Sirota | 135/16 |
| 4,606,366 | A | * | 8/1986 | Collet | 135/20.1 |
| 4,821,756 | A | * | 4/1989 | England | 135/19.5 |
| 4,966,179 | A | * | 10/1990 | Baldwin et al. | 135/19.5 |
| 5,682,915 | A | | 11/1997 | Martin | |
| 5,960,806 | A | * | 10/1999 | Steiner | 135/20.1 |
| 6,273,111 | B1 | * | 8/2001 | Weiss et al. | 135/25.41 |
| 6,321,763 | B1 | * | 11/2001 | Ma | 135/20.1 |
| 6,478,037 | B2 | * | 11/2002 | Tung | 135/21 |
| 6,988,504 | B1 | * | 1/2006 | Goldwitz | 135/20.1 |

FOREIGN PATENT DOCUMENTS

| | | | | |
|---|---|---|---|---|
| BE | 570758 | | | 9/1958 |
| DE | 3808529 | C1 | * | 5/1989 |
| EP | 1410729 | A1 | | 4/2004 |
| FR | 1429394 | A | | 1/1966 |
| GB | 2346556 | A | * | 8/2000 |
| JP | 2001029115 | A | * | 2/2001 |
| WO | WO 8909589 | A1 | * | 10/1989 |

* cited by examiner

*Primary Examiner*—Winnie Yip
(74) *Attorney, Agent, or Firm*—Birch, Stewart, Kolasch & Birch, LLP

(57) ABSTRACT

A parasol provided with a sun-blocking screen which is centrally provided with a connecting piece from which the screen can assume a collapsed condition and a folded-out condition extending substantially radially outwards, wherein the parasol is provided with a housing in which the screen in a collapsed condition is received, while the sun-blocking screen in the folded-out condition is located outside the housing.

15 Claims, 7 Drawing Sheets

PARASOL

BACKGROUND OF THE INVENTION (1) Field of the Invention

The invention relates to a parasol provided with a sun-blocking screen which is centrally provided with a connecting piece from which the screen can assume a collapsed condition and a folded-out condition extending substantially radially outwards.

(2) Description of the Related Art

Such a parasol is known from practice and is typically provided with a cloth stretched over ribs. The ribs are pivotally connected by one end to the connecting piece, and in the folded-out condition the cloth is stretched over the ribs. However, also known are parasols which, instead of a cloth, have several feather-like or leaf-like ribs jointly forming the screen when the parasol is in the folded-out condition.

A drawback of the known parasols is that they must each time be removed in view of pollution, damage, vandalism, wind and the like but especially because the known parasol obstructs the view on the terrace and limits a further use of the available space.

SUMMARY OF THE INVENTION

The invention contemplates a parasol without the drawbacks mentioned and to this end provides a parasol of the type described in the opening paragraph, which is characterized in that the parasol is provided with a housing in which the screen in a collapsed condition is received, while the sun-blocking screen in the folded-out condition is located outside the housing.

An Appendix including amended drawing figures is attached following page 8 of this paper.

As in a collapsed condition the screen is received in the, preferably sleeve-shaped, housing, the parasol forms much less of an obstacle when it is not in use. The consequence is therefore that the parasol will be put up much sooner because in collapsed condition, it does not obstruct the view or take up space on the terrace or like surrounding in an inconvenient manner.

According to a further elaboration of the invention, the parasol is provided with an operating device designed for bringing the sun-blocking screen from its collapsed condition received in the housing to its folded-out condition located outside the housing, and vice versa.

Such an operation can be manually or electrically energized and simplifies moving the screen into and out of the housing.

According to a further elaboration of the invention, the operating device can be designed such that with one operating action, bringing the screen into and out of the housing, respectively, and collapsing and folding out the screen, respectively, is effected.

This naturally offers the advantage that moving the screen into and out of the housing, as well as folding the screen in and out, can be accomplished with a single operating action. With electric excitation, only a single electric motor needs to be provided.

Preferably, the screen is movable into and out of the housing via an end face of the housing which is open.

It is then preferred that the respective free end face is a downwardly directed free end of the housing.

Optionally, the parasol is provided with at least one lamp, such that the parasol in collapsed condition can serve as a lighting element.

Then, for instance, a lamp can screen off the free end face when the parasol is in collapsed condition.

The screen can be provided with ribs, which ribs are connected by a first end to the central connecting piece, while the ribs in the collapsed condition of the screen extend substantially parallel to each other and the ribs in the folded-out condition of the screen extend substantially radially from the central connecting piece.

Although the ribs will generally be manufactured from rigid or slightly flexible, substantially rod-shaped material, it is also possible, according to an alternative elaboration of the invention, that instead of or in addition to the ribs, the screen is provided with at least one inflatable element, while in inflated condition of the inflatable element the screen is in the folded-out condition and in a non-inflated condition the screen is collapsed, at least collapsible. The inflatable element can for instance be a circular band bounding the circumferential edge of the screen. However, it is also possible that a type of inflatable ribs is provided instead of the customarily used ribs.

According to a further elaboration, with a design with flexible ribs or with inflatable ribs, it is also possible that the preferably sleeve-shaped housing is slightly curved. Such a slightly bent or curved housing may be desired from an aesthetic point of view.

The housing can be connected to a floor stand or to a stand anchored in the ground. However, it is also possible that the housing is connected to a wall or ceiling attachment.

In order to move the screen in the housing in an efficient manner, according to a further elaboration of the invention, the connecting piece can be rotated when it is being moved into the housing. In particular with a screen provided with screen cloth, this leads to a well-defined formation of folds. However, also with the feather-like or leaf-like ribs, rotation of the connecting piece can provide a more efficient and more controlled accommodation of the screen in the housing.

Optionally, the connection between the connecting piece and the operating device can be flexible, which is particularly advantageous for absorbing wind load.

In order to limit friction as much as possible when the screen is being moved into the housing, the end edge of the housing, which defines the open, free end face of the housing, can be provided with a rounding and, optionally, a flexible edge with a low coefficient of friction.

The invention will be further clarified hereinafter on the basis of a number of exemplary embodiments with reference to the drawing.

DETAILED DESCRIPTION OF THE INVENTION

Figure 2:
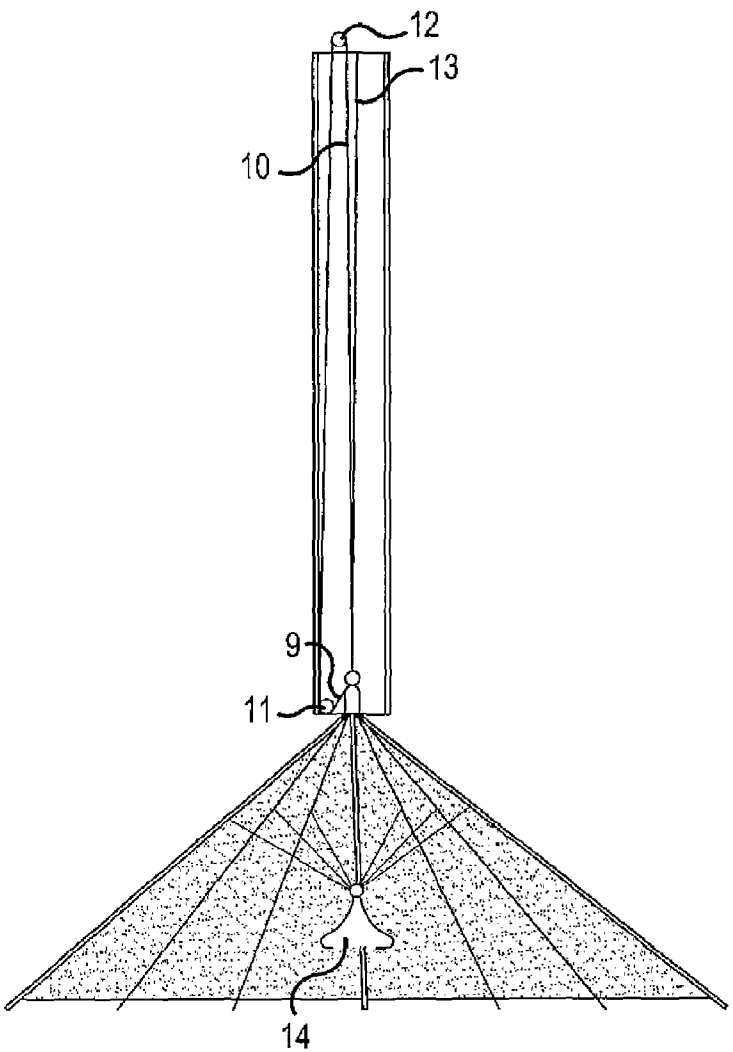
FIG. 2 shows a similar cross-sectional view in partly collapsed condition.

FIGS. 1-4 show an exemplary embodiment of a parasol 1 which is provided with a sun-blocking screen 2 which is centrally provided with a connecting piece 3 from which the screen 2 can assume a collapsed condition (see FIGS. 3 and 4) and a folded-out condition (see FIG. 1) extending substantially radially outwards. The parasol 1 is further provided with a preferably sleeve-shaped housing 4 in which the screen 2 is received in collapsed condition (see FIG. 4). In the folded-out condition, the sun-blocking screen 2 is located outside the sleeve-shaped housing 4 (see FIG. 1). In the present exemplary embodiment, the screen 2 is provided with ribs 5 between which extends a screen cloth D. The ribs 5 are pivotally connected by a first end to the central connecting piece 3. With the screen 2 in collapsed condition, the ribs 5 extend substantially parallel to each other. With the screen 2 in folded-out condition, the ribs extend substantially radially from the central connecting piece 3. The parasol 1 is further provided with operating rods 6 which are connected by a first end to a central operating rod connecting piece 7. Each operating rod 6 is connected by a second end to a rib at a position located between the ends of the respective ribs.

The parasol is further provided with an operating device which is designed for bringing the sun-blocking screen 2 from the collapsed condition received in the housing 4 to the folded-out condition located outside the housing, and vice versa. In the present exemplary embodiment, this operating device is designed such that one operating action causes the screen 2 to be brought into or out of the housing 4, respectively, as well as to be collapsed or folded-out, respectively. It is clear that in the present exemplary embodiment, the screen 2 is movable into and out of the housing 4 via an end face 8 of the housing 4, which end 8 is open.

Figure 1:
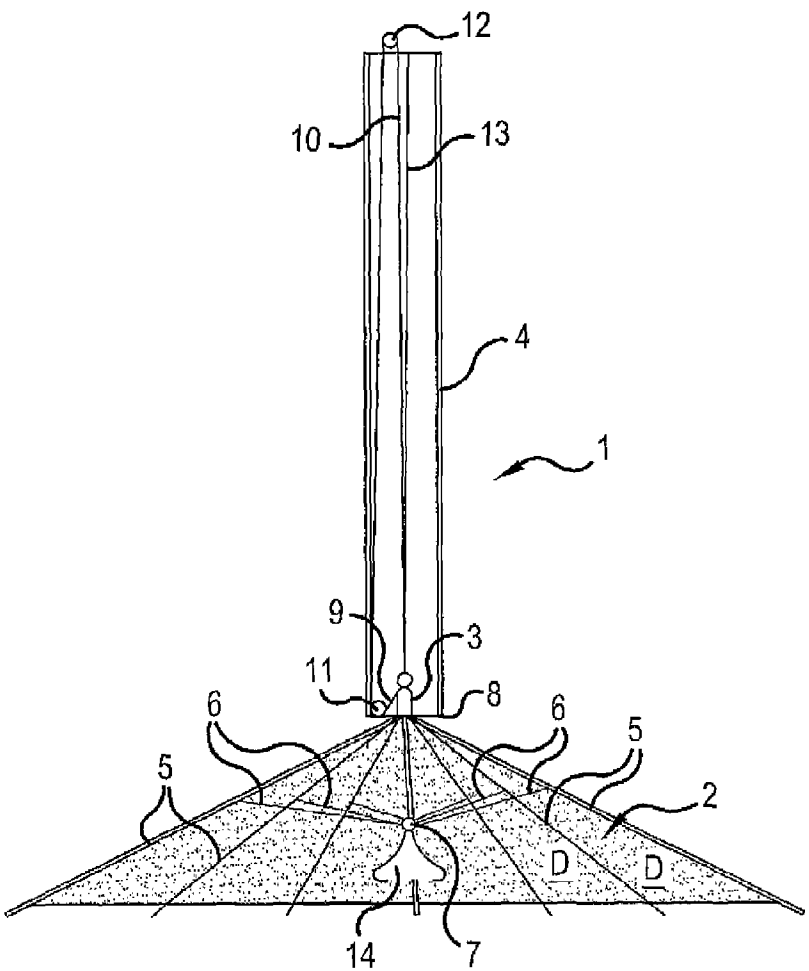
FIG. 1 shows a first exemplary embodiment of a parasol in cross-sectional view in folded-out condition.
Figure 3:
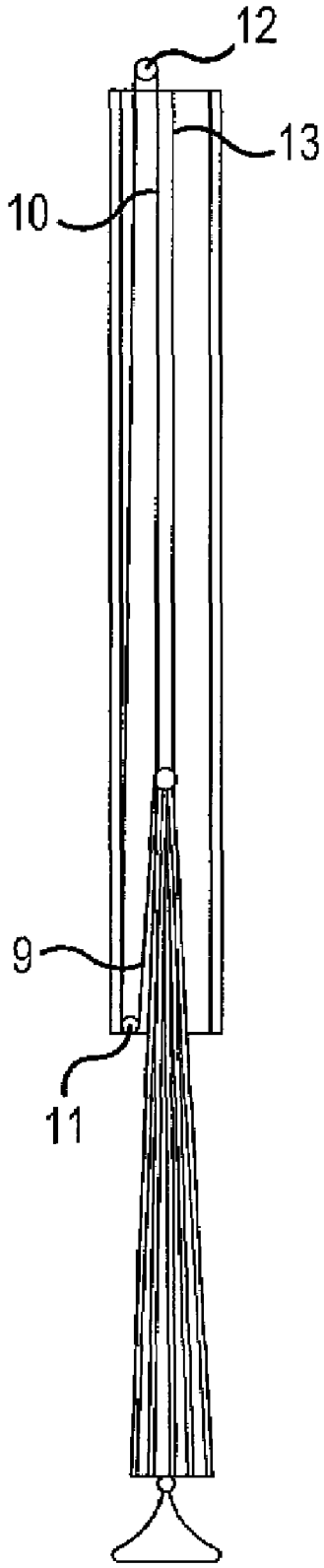
FIG. 3 shows a similar cross-sectional view in a condition moved partly into the housing.

The operating device comprises a first cord part 9 (see FIG. 3) with the aid of which the central connecting piece 3 is movable from a first position corresponding to the collapsed condition of the screen 2 (see FIG. 4) to a second position corresponding to the folded-out condition of the screen 2 (see FIG. 1). The operating device further comprises a second cord part 10 with the aid of which the central connecting piece 3 is movable from the second position corresponding to the folded-out condition of the screen (see FIG. 1) to the first position corresponding to the collapsed condition of the screen 2 (see FIG. 4). The first cord part 9 extends from the central connecting piece 3 to a first guiding element 11 which is connected to the housing 4 and which is situated near the open end face 8 of the housing 4. The second cord part 10 extends from the central connecting piece 3 to the second guiding element 12 situated on a side of the first position of the connecting piece 3 remote from the end face 8. Preferably, the first cord part 9 and the second cord part 10 form part of one cord closed upon itself, which is stretched over the first and the second guiding element 11, 12, respectively. Here, a part of the cord 9, 10 can extend within the housing 4 and a part of the cord can extend outside the housing 4, while naturally, the central connecting piece 3 is connected to the part of the cord extending within the housing. Via a cord, elastic, spring or such connecting element 13, the central operating rod connecting piece 7 is connected to the housing 4. The length of the connecting element 13 is selected such that when the screen 2 is being brought to the folded-out condition moved outside the housing 4, this connecting element 13 tightens, so that the screen 2 automatically assumes the folded-out condition.

In order to promote folding of the screen cloth D, a rotation can be imposed on the connecting piece 3 when this connecting piece is moved upwards into the housing 4. When the screen 2 is thus slid upward in the housing 4 in a rotating manner, the screen cloth is folded tightly, which allows the housing 4 to be made of slim design.

Further, it is preferred that the connection between the connecting piece 3 and the operating device, in the present case the cord 9, 10, is flexible so that wind load of the screen 2 can be absorbed by pivoting the screen 2.

The lower edge 8 of the housing 4, which defines the opening in the free end face of the housing 4, is preferably rounded off and, optionally, provided with a flexible edge with a low coefficient of friction.

Figure 5:
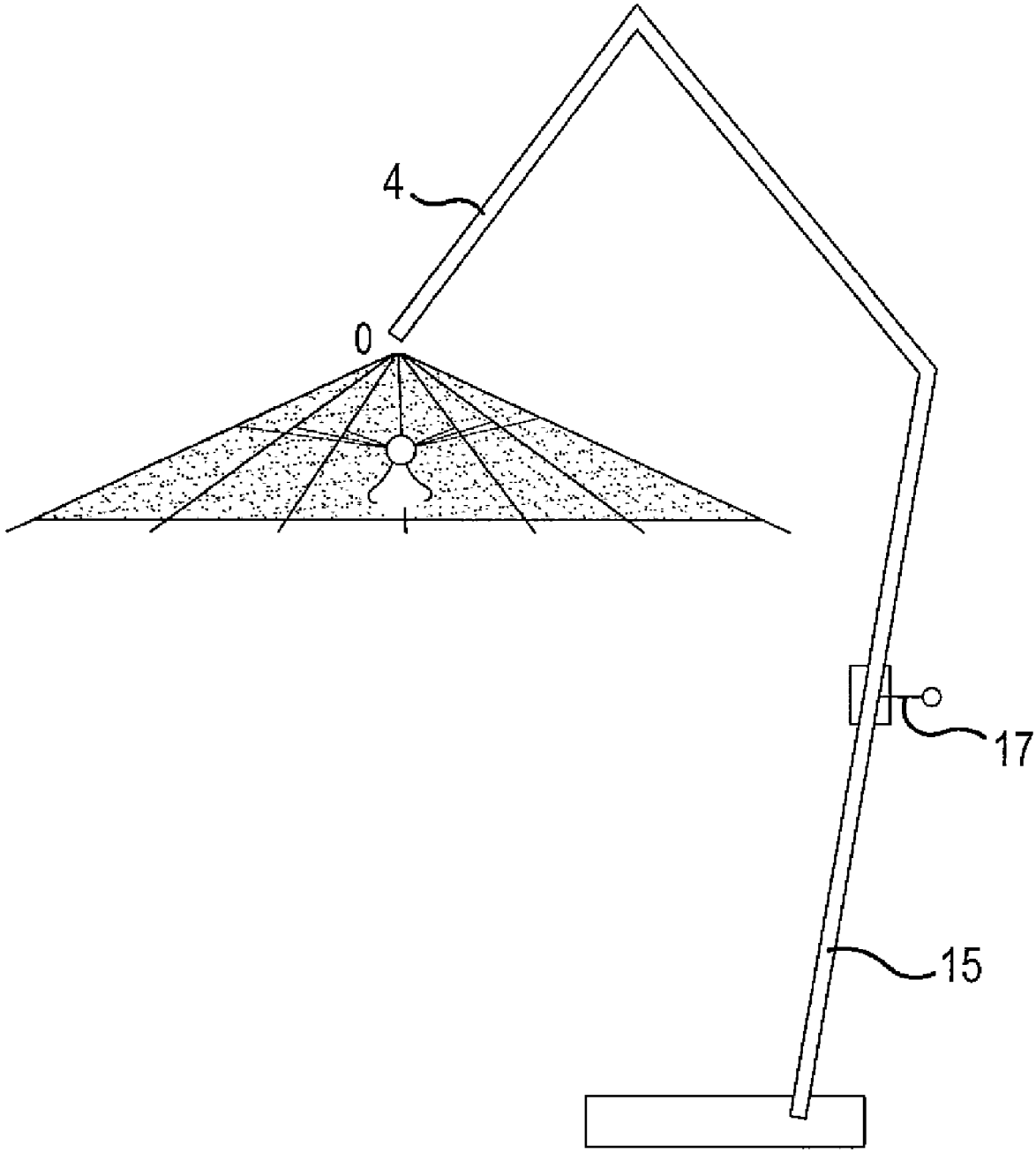
FIG. 5 shows a side view of a parasol, with the housing connected to a floor stand.
Figure 6:
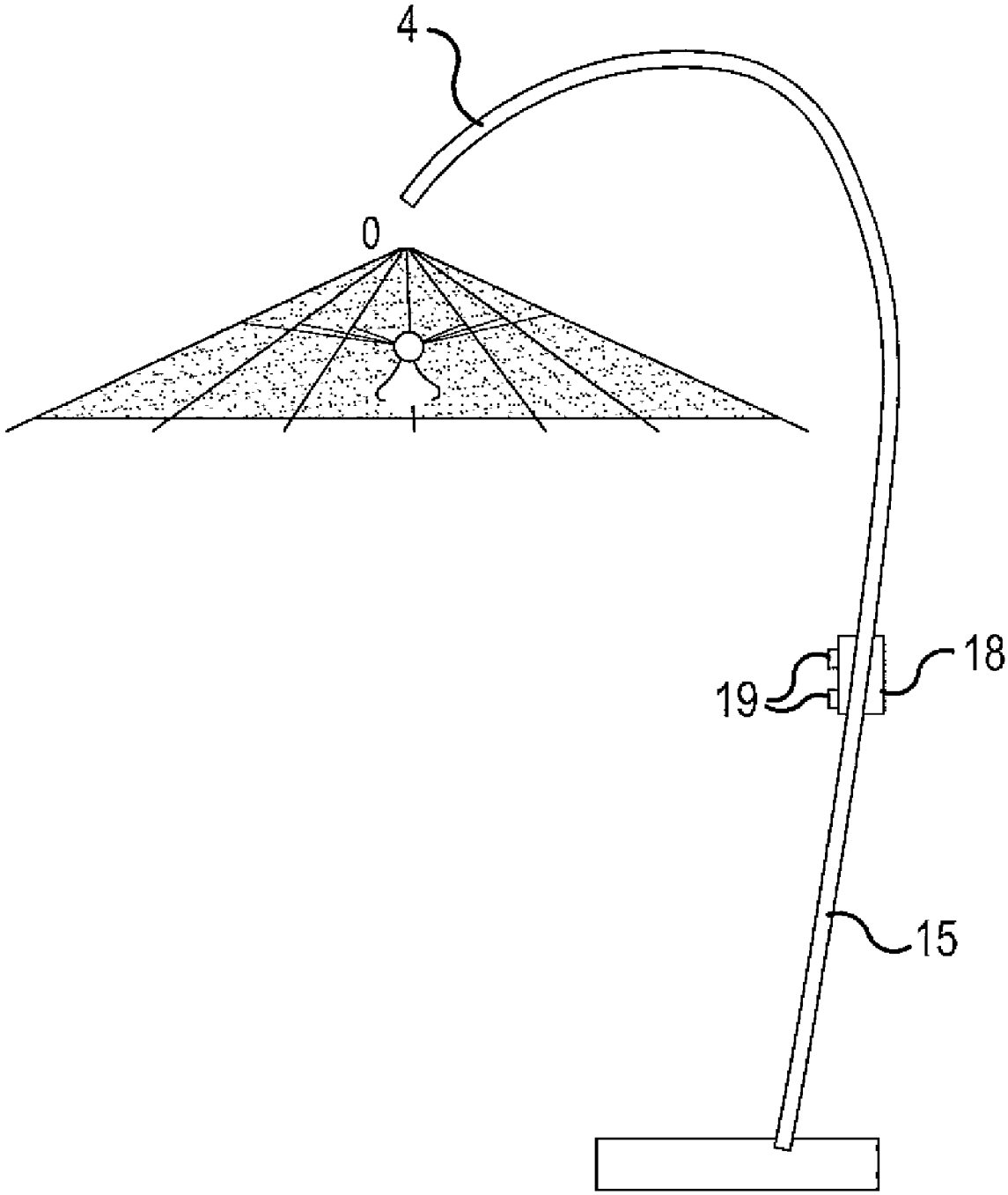
FIG. 6 shows a similar view as represented in FIG. 5, with the housing being curved.

The first cord part 9 and the second cord part 10 can be connected via cords to a handle 17 (see FIG. 5) or to an electric motor 18 with control buttons 19 (see FIG. 6).

Figure 4:
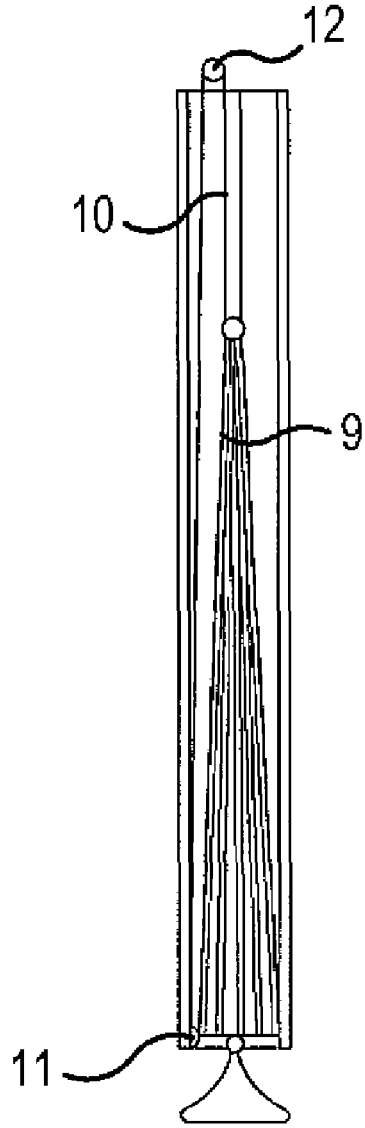
FIG. 4 shows a similar view in a condition moved completely into the housing.

In the exemplary embodiment represented in FIGS. 1-4, the parasol 1 is provided with a lamp 14 which is connected to the screen 2 or the housing 4, such that the parasol 1 in collapsed condition can serve as a lighting element (see FIG. 4). It is clearly visible that the lamp 14 screens off the free end face 8 in the collapsed condition of the screen 2.

Figure 7:
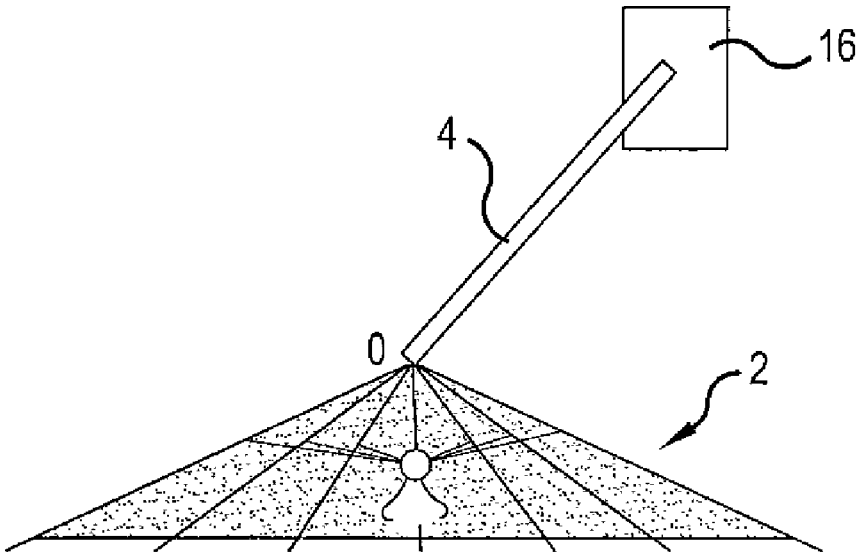
FIG. 7 shows a side view of a parasol, with the housing connected to a wall attachment.

The exemplary embodiment represented in FIGS. 1-4 can for instance be connected to a floor stand 15 as represented in FIGS. 5 and 6. The design of FIG. 6 has as a special feature that the design of the housing 4 is slightly curved. If the screen is provided with ribs 5, in the exemplary embodiment of FIG. 6, these must naturally be designed to be slightly flexible. Optionally, the housing 4 can also be connected to a standard anchored in the floor (not represented) or to a wall or ceiling attachment 16 (see FIGS. 7 and 8).

Figure 8:
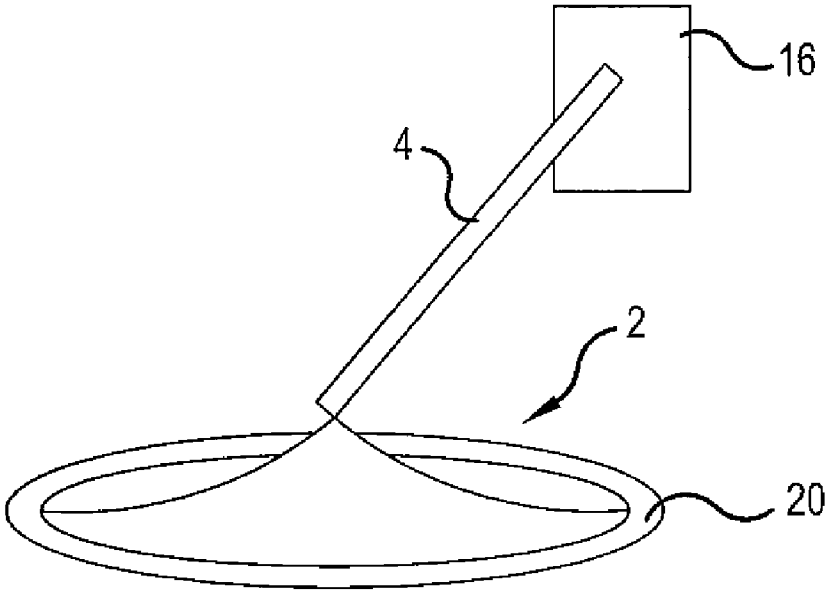
FIG. 8 shows an exemplary embodiment of the screen provided at the circumferential edge with an inflatable element.
Figure 12:
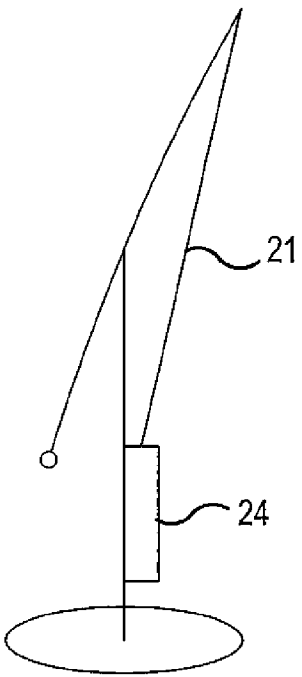
FIGS. 9-12 show another embodiment in different positions.
Figure 11:
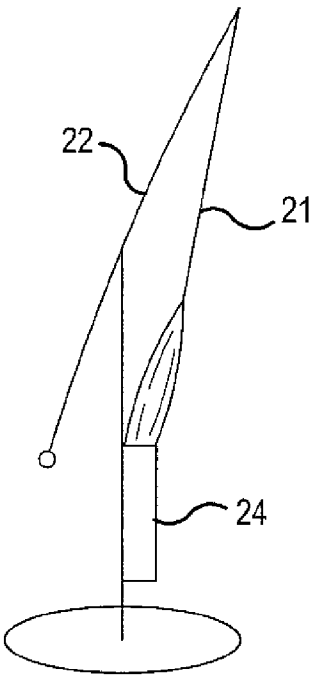
Figure 10:
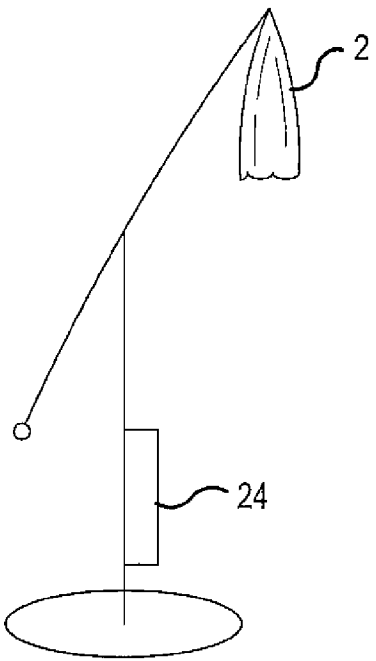
Figure 9:
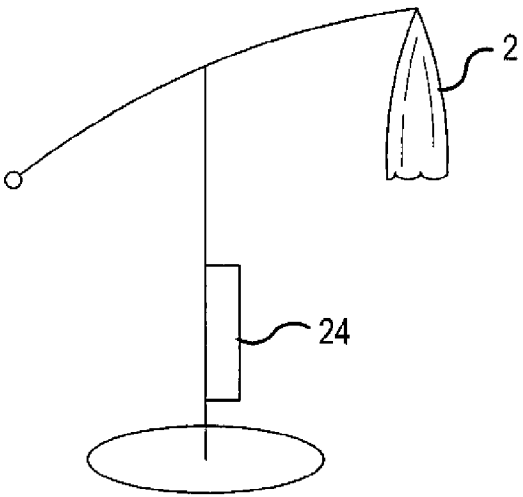

FIG. 8 shows an embodiment of a parasol 1, wherein the screen 2 is not provided with ribs but instead is provided with an inflatable element 20. In an inflated condition of the inflatable element 20, the screen 2 is in a folded-out condition. In a non-inflated condition of the inflatable element 20, the screen 2 is collapsed, or at least collapsible. In the exemplary embodiment shown, the inflatable element 20 is designed as a ring or band 20 closed upon itself, which defines the outer circumferential edge of the screen 2. However, it is also possible that the inflatable elements are designed as inflatable ribs.

FIGS. 9-12 show a completely different design of a parasol according to the invention, wherein the screen 2 is connected via a cord 21 to a rod 22 which is pivotally connected to a stand 23. On the stand 23, a sleeve-shaped housing 24 is provided. By pivoting the rod 22 in a vertical position, and by paying out the cord 21, the screen 2 can be accommodated in the housing 24 (see FIG. 12).

Figure 15:
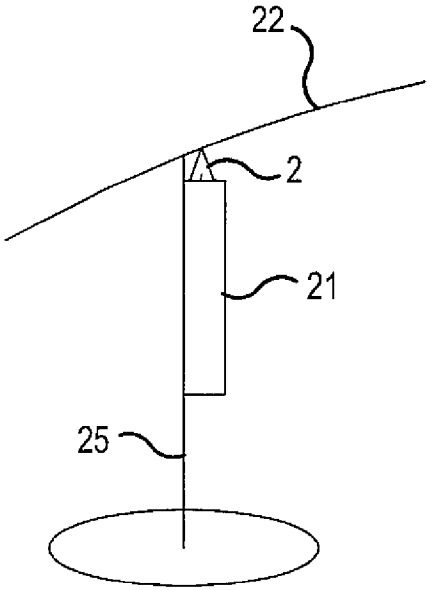
FIGS. 13-15 show yet another embodiment in different positions.
Figure 14:
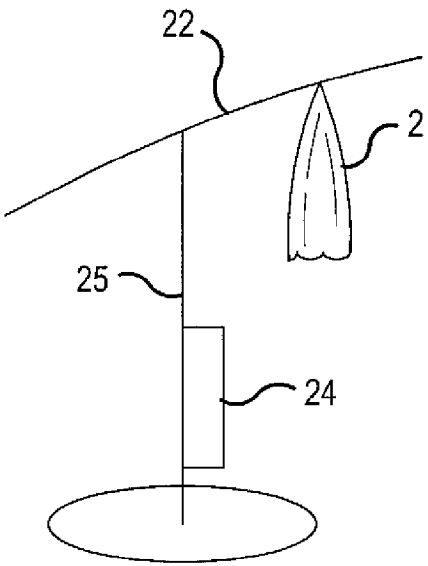
Figure 13:
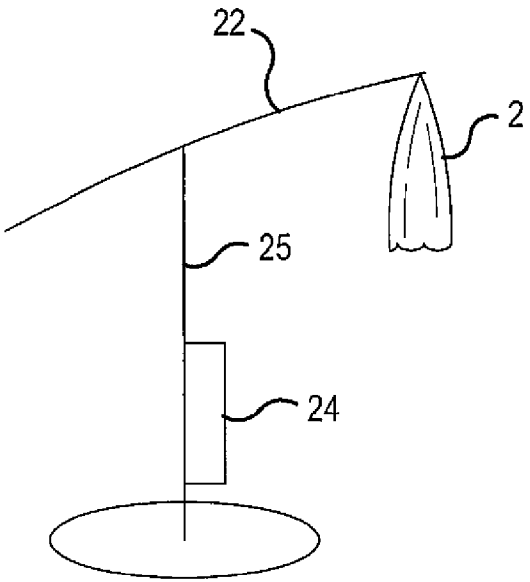

FIGS. 13-15 show yet another variant of a parasol according to the invention, wherein the screen 2 is slideably connected to a rod 22. A housing 24 is slideably connected to a stand 25, which stand 25 also bears the rod 22. The screen 2 can be stored by sliding it along the rod 22 to the stand 25, and then moving the housing 24 upwards along the rod 25 and accommodating the screen 2 in it.

It is clear that the parasol according to the invention will have many applications, both indoors and outdoors. Not only terraces but also boats, caravans and cars could be equipped with such a parasol, for private as well as professional uses. Owing to the smooth appearance of the preferably sleeve-shaped housing, in combination with various color options and choices of material of the parasol and the housing, there is a large choice in design. Naturally, a stand can be provided with several housings 4 and fully automatic systems are conceivable which automatically collapse and fold out depending on the weather conditions.

Further, instead of a screen cloth stretched over ribs, use can be made of ribs having a feather-like or leaf-like configuration and thus forming a sun-blocking screen 2 in folded-out condition.

The invention claimed is:

1. A parasol comprising:

a sun-blocking screen;

a connecting piece that is centrally provided on the sun-blocking screen and from which the screen can assume a collapsed condition and a folded-out condition extending substantially radially outwards;

a housing having an open end face defined by an end edge via which the screen is movable into and out of the housing, the sun-blocking screen being received in the collapsed condition in the housing, and being located outside the housing in the folded-out condition; and an operating device configured to bring in a single user operating action the sun-blocking screen from its collapsed condition located inside the housing to its folded-out condition located outside the housing and configured to bring in a single user operating action the sun-blocking screen from its folded-out condition located outside the housing to its collapsed condition located inside the housing, the operating device including:

a first cord part with the aid of which the central connecting piece is movable from a first position corresponding to the collapsed condition of the screen to a second position corresponding to the folded-out condition of the screen, the first cord part extending from the central connecting piece to a first guiding element that is connected to the housing and that is situated near the open end face of the housing; and a second cord part with the aid of which the central connecting piece is movable from the second position corresponding to the folded-out condition of the screen to the first position corresponding to the collapsed condition of the screen, the second cord part extending from the central connecting piece to a second guiding element that is connected to the housing and that is situated on a side of the first position that is remote from the end face.

2. A parasol according to claim 1, wherein the first cord part and the second cord part form part of one cord closed upon itself.

3. A parasol according to claim 2, wherein the cord closed upon itself is guided over the first and the second guiding elements.

4. A parasol according to claim 1, the parasol further including:

ribs having first and second end, the ribs being connected to the screen and the first free ends being connected by a first end to the central connecting piece, wherein the ribs in the collapsed condition of the screen extend substantially parallel to each other and wherein the ribs in the folded-out condition of the screen extend substantially radially from the central connecting piece.

5. A parasol according to claim 4, the parasol further including:

at least a number of operating rods each having a first end and a second end; and a central operating rod connecting piece, wherein each operating rod is connected with the first end to the central operating rod connecting piece, while the second end of each operating rod being connected by an associated rib at a position located between free ends of the respective ribs.

6. A parasol according to claim 5, wherein the central operating rod connecting piece is connected to the housing via a connecting element chosen from the group including a cord, an elastic and a spring, the length of the connecting element being selected such that when the screen is brought to the folded-out position moved outside the housing, this connecting element tightens, so that the screen automatically assumes the folded-out condition.

7. A parasol according to claim 1, provided with at least one lamp, such that the parasol in a collapsed condition can serve as a lighting element.

8. A parasol according to claim 7, wherein a lamp screens off the open end face of the housing in the collapsed condition of the parasol.

9. A parasol according to claim 1, wherein the housing is sleeve-shaped.

10. A parasol according to claim 9, wherein the sleeve-shaped housing is slightly curved.

11. A parasol according to claim 1, wherein the housing is connected to an upper portion of a floor stand or a stand anchored in the ground.

12. A parasol according to claim 1, wherein the housing is connected to a wall or ceiling attachment.

13. A parasol according to claim 1, wherein the connecting piece is rotated when it is being moved into the housing.

14. A parasol according to claim 1, wherein a connection between the connecting piece and the operating device is flexible.

15. A parasol according to claim 14, wherein the end edge of the housing is provided with a rounding and, optionally, a flexible edge with a low coefficient of friction.

* * * * *